US011605334B2

(12) United States Patent
Bae et al.

(10) Patent No.: US 11,605,334 B2
(45) Date of Patent: Mar. 14, 2023

(54) HOST PROCESSOR, DISPLAY SYSTEM INCLUDING THE HOST PROCESSOR, AND METHOD OF OPERATING THE DISPLAY SYSTEM

(71) Applicant: Samsung Display Co., Ltd., Yongin-Si (KR)

(72) Inventors: Jongman Bae, Seoul (KR); Jundal Kim, Asan-si (KR); Kyungyoul Min, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/578,835

(22) Filed: Jan. 19, 2022

(65) Prior Publication Data

US 2022/0392393 A1 Dec. 8, 2022

(30) Foreign Application Priority Data

Jun. 7, 2021 (KR) ..... 10-2021-0073334

(51) Int. Cl.
*G09G 3/20* (2006.01)

(52) U.S. Cl.
CPC ..... *G09G 3/2096* (2013.01); *G09G 2330/021* (2013.01)

(58) Field of Classification Search
CPC ..... G09G 2330/021; G09G 3/2096
See application file for complete search history.

(56) References Cited

U.S. PATENT DOCUMENTS

2003/0011547 A1* 1/2003 Igarashi ..... G09G 3/20 345/87
2014/0176412 A1* 6/2014 Oh ..... G09G 3/3611 345/99
2019/0235878 A1* 8/2019 Lin ..... G06F 3/14 710/38

FOREIGN PATENT DOCUMENTS

CN 103270720 A * 8/2013 ..... H04W 88/04
JP 2007256917 A * 10/2007 ..... G09G 3/3648
KR 102023939 B1 11/2019

* cited by examiner

*Primary Examiner* — Towfiq Elahi
(74) *Attorney, Agent, or Firm* — Cantor Colburn LLP

(57) ABSTRACT

A host processor includes a high-speed driver which generates first high-speed data, a coupling circuit which receives the first high-speed data from the high-speed driver, and removes a direct-current ("DC") component of the first high-speed data to generate second high-speed data, a low-power driver which generates low-power data, and a passive switch which receives the second high-speed data from the coupling circuit, receives the low-power data from the low-power driver, and selectively outputs the second high-speed data or the low-power data to a display apparatus.

20 Claims, 7 Drawing Sheets

| | 1H | HS | LP |
|---|---|---|---|
| FHD + (60Hz) | 6.55[μs] | 1.45[μs] | 5.1[μs] |
| WQHD + (60Hz) | 4.93[μs] | 1.92[μs] | 3.1[μs] |

HOST PROCESSOR, DISPLAY SYSTEM INCLUDING THE HOST PROCESSOR, AND METHOD OF OPERATING THE DISPLAY SYSTEM

This application claims priority to Korean Patent Application No. 10-2021-0073334, filed on Jun. 7, 2021, and all the benefits accruing therefrom under 35 U.S.C. § 119, the content of which in its entirety is herein incorporated by reference.

BACKGROUND

1. Field

Embodiments of the invention relate to a host processor. More particularly, embodiments of the invention relate to a host processor adjusting a voltage value of data, a display system including the host processor, and method of operating the display system.

2. Description of the Related Art

As performance of a display apparatus, an image sensor, etc., included in a mobile apparatus is improved and a resolution is increased, an amount of transmitted data is rapidly increasing. Advances in the mobile apparatus increase the number of internal wiring and increase electromagnetic interference ("EMI"). In order to solve these problems, a serial interface, such as a mobile industry processor interface ("MIPI"), for data transmission between a host processor and the display apparatus is being studied.

SUMMARY

A serial interface has various transmission methods, and a voltage range of transmitted data may vary for the respective transmission methods. When data generated by a host processor is out of the voltage range depending on the transmission method of the interface, the host processor may not be able to transmit data normally.

Embodiments of the invention provide a host processor adjusting a voltage value of data and outputting data with the adjusted voltage value to a display apparatus.

Embodiments of the invention provide a display system including the host processor.

Embodiments of the invention also provide a method of operating the display system.

In an embodiment of a host processor which communicates with a display apparatus according to the invention, the host processor includes a high-speed driver which generates first high-speed data, a coupling circuit which receives the first high-speed data from the high-speed driver and removes a direct-current ("DC") component of the first high-speed data to generate second high-speed data, a low-power driver which generates low-power data, and a passive switch which receives the second high-speed data from the coupling circuit, receives the low-power data from the low-power driver, and selectively outputs the second high-speed data or the low-power data to the display apparatus.

In an embodiment, the coupling circuit may include a capacitor for removing the DC component of the first high-speed data.

In an embodiment, a capacitance of the capacitor may be determined depending on a resolution of the display apparatus.

In an embodiment, the first high-speed data may include a toggle pattern.

In an embodiment, the coupling circuit may set a DC voltage value of the second high-speed data in a first low-power period before an initial high-speed period.

In an embodiment, the first high-speed data may include the toggle pattern in the first low-power period before the initial high-speed period.

In an embodiment, the coupling circuit may maintain the DC voltage value of the second high-speed data in a second low-power period after the initial high-speed period.

In an embodiment, the first high-speed data may include the toggle pattern in the second low-power period.

In an embodiment, the coupling circuit may include a capacitor part which removes the DC component of the first high-speed data, and a setting part which receives a power supply voltage and sets a DC voltage value of the second high-speed data based on the power supply voltage.

In an embodiment, the setting part may include a first resistor including a first end which receives the power supply voltage and a second end connected to an output node, and a second resistor including a first end that is grounded and a second end connected to the output node.

The setting part may set the DC voltage value of the second high-speed data based on the power supply voltage, a resistance of the first resistor, and a resistance of the second resistor.

In an embodiment of a display system according to the invention, the display system includes a host processor and a display apparatus. The host processor includes a high-speed driver which generates first high-speed data, a coupling circuit which receives the first high-speed data from the high-speed driver and removes a DC component of the first high-speed data to generate second high-speed data, a low-power driver which generates low-power data, and a passive switch which receives the second high-speed data from the coupling circuit, receives the low-power data from the low-power driver, and selectively outputs the second high-speed data or the low-power data to the display apparatus.

In an embodiment, the coupling circuit may include a capacitor for removing the DC component of the first high-speed data.

In an embodiment, the coupling circuit may set a DC voltage value of the second high-speed data in a first low-power period before an initial high-speed period.

In an embodiment, the first high-speed data may include a toggle pattern in the first low-power period before the initial high-speed period.

In an embodiment, the coupling circuit may maintain the DC voltage value of the second high-speed data in a second low-power period after the initial high-speed period.

In an embodiment, the first high-speed data may include the toggle pattern in the second low-power period.

In an embodiment, the coupling circuit may include a capacitor part which removes the DC component of the first high-speed data and a setting part which receives a power supply voltage and sets a DC voltage value of the second high-speed data based on the power supply voltage.

In an embodiment of a method of operating a display system according to the invention, the method includes generating first high-speed data and low-power data, generating second high-speed data based on the first high-speed data, selectively outputting the second high-speed data or the low-power data to a display apparatus, and operating the display apparatus based on the second high-speed data and the low-power data. The generating the second high-speed data includes removing a DC component of the first high-speed data, setting a DC voltage value of the second high-speed data, and maintaining the DC voltage value of the second high-speed data.

In an embodiment, the first high-speed data may include a toggle pattern.

In an embodiment, setting the DC voltage value of the second high-speed data may be performed in a first low-power period before an initial high-speed period. Maintaining the DC voltage value of the second high-speed data may be performed in a second low-power period after the initial high-speed period.

A host processor in embodiments of the invention may output data having a desired DC voltage value to a display apparatus by removing a DC component of first high-speed data and generating second high-speed data having a new DC voltage value.

A host processor in embodiments of the invention may prevent DC distortion by adding a toggle pattern to first high-speed data.

A host processor in embodiments of the invention may maintain a DC voltage value of second high-speed data by periodically adding a toggle pattern to first high-speed data.

A display system in embodiments of the invention includes a host processor that outputs data having a desired DC voltage value to a display apparatus, so that data transmission between the host processor and the display apparatus may be performed normally.

A method of operating a display system in embodiments of the invention may allow data to have a desired DC voltage value, so that data transmission between the host processor and the display apparatus may be performed normally.

However, the effects of the invention are not limited to the above-described effects, and may be variously expanded without departing from the spirit and scope of the invention.

BRIEF DESCRIPTION OF THE DRAWINGS

The above and other features and advantages of the invention will become more apparent by describing in detailed embodiments thereof with reference to the accompanying drawings, in which.

DETAILED DESCRIPTION

Figure 1:
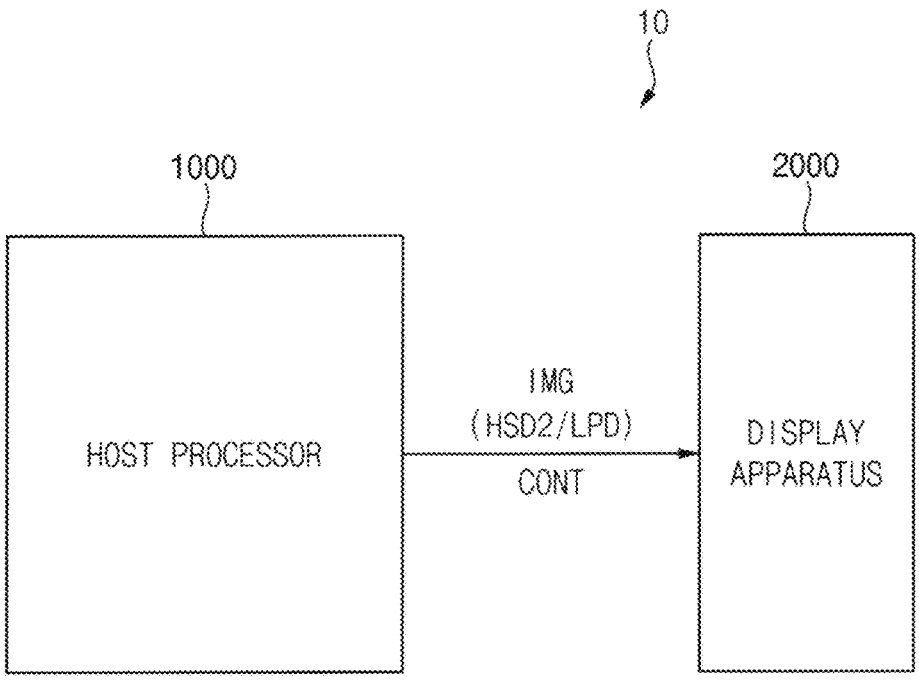
FIG. 1 is a block diagram illustrating an embodiment of a display system according to the invention.

Hereinafter, the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

FIG. 1 is a block diagram illustrating an embodiment of a display system 10 according to the invention.

Referring to FIG. 1, the display system 10 may include a host processor 1000 and a display apparatus 2000. Input image data IMG may include second high-speed data HSD2 or low-power data LPD. In an embodiment, the input image data IMG may include red image data, green image data, and blue image data. In an embodiment, the input image data IMG may further include white image data. In another embodiment, the input image data IMG may include magenta image data, yellow image data, and cyan image data. An input control signal CONT may include a master clock signal and a data enable signal. The input control signal CONT may further include a vertical synchronization signal and a horizontal synchronization signal.

The display apparatus 2000 may receive the input image data IMG and the input control signal CONT from the host processor 1000 through an interface. In an embodiment, the display apparatus 2000 may be a mobile apparatus. In an embodiment, the mobile apparatus may be implemented as a mobile phone, a smart phone, a tablet personal computer ("PC"), a personal digital assistant ("PDA"), an enterprise digital assistant ("EDA"), a digital still camera, a digital video camera, a portable multimedia player ("PMP"), a personal navigation apparatus (or device") ("PND"), a mobile internet device ("MID"), or a wearable computer, etc., for example. In an embodiment, the interface may be a digital visual interface ("DVI"), a high definition multimedia interface ("HDMI"), a mobile industry processor interface ("MIPI"), and a display port, etc., for example. A range of a voltage value of the input image data IMG applied to the display apparatus 2000 may be determined depending on a transmission method of the interface. In an embodiment, a scalable low voltage signaling ("SLVS") transmission method may transmit data having a direct current ("DC") voltage value of about 200 millivolts (mV) and a swing voltage value of about 100 mV, for example. In an embodiment, the SLVS transmission method may transmit the data having a voltage value of about 100 mV to about 300 mV, for example. In an embodiment, a low voltage metal oxide semiconductor ("LVCMOS") transmission method may transmit the data having voltage value of about 0 volt (V) to about 1.2V, for example. Accordingly, the host processor 1000 may be desired to adjust voltage value of the data, so that the input image data IMG is included in a range of a voltage value determined depending on the interface transmission method. In an embodiment, the host processor 1000 may use the SLVS transmission method in a high-speed mode and use the LVCMOS transmission method in a low-power mode, for example.

Figure 2:
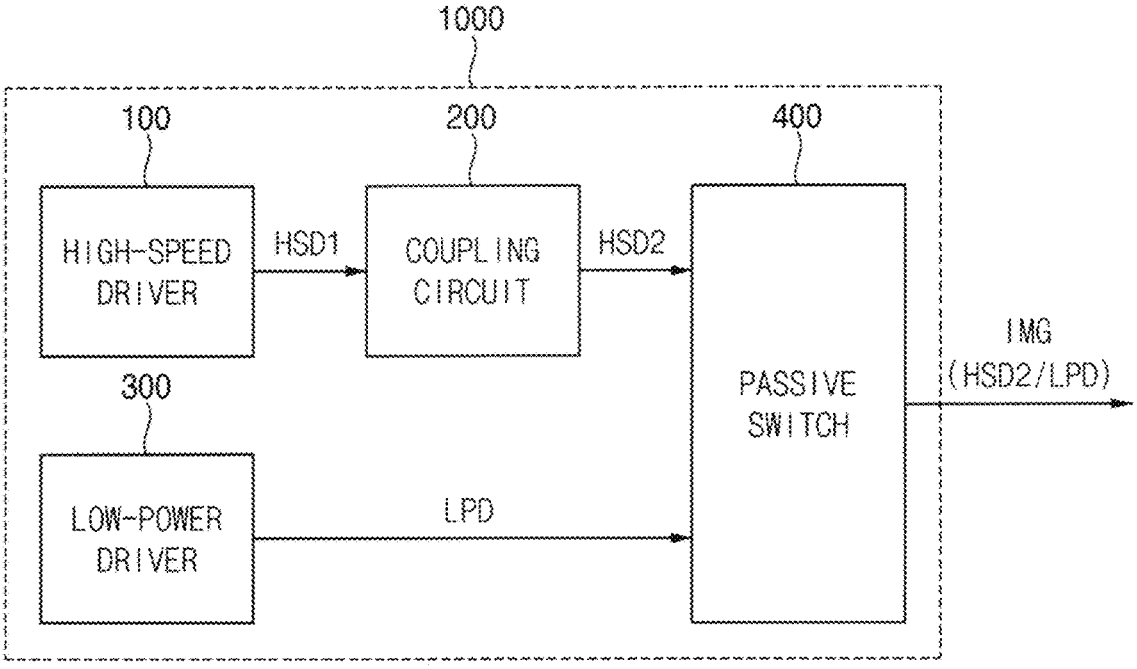
FIG. 2 is a block diagram illustrating a host processor of the display system of FIG. 1.

FIG. 2 is a block diagram illustrating the host processor 1000 of the display system 10 of FIG. 1.

Referring to FIG. 2, the host processor 1000 may include a high-speed driver 100, a coupling circuit 200, a low-power driver 300, and a passive switch 400. In an embodiment, the high-speed driver 100 and the low-power driver 300 may be integrated into one field programmable gate array ("FPGA") chip or one integrated circuit ("IC") chip.

The high-speed driver 100 may generate first high-speed data HSD1. Here, the high-speed data (e.g. the first high-speed data HSD1 or the second high-speed data HSD2) may be transmitted in the high-speed mode in which the host processor 1000 transmits data to the display apparatus 2000 at high-speed. In an embodiment, the high-speed data may have a data transmission rate of up to about 2.5 gigabits per second (Gb/s) in one lane, for example. In an embodiment, the high-speed data may be transmitted using the SLVS transmission method, for example. In an embodiment, the first high-speed data HSD1 may be a differential signal. In an embodiment, the first high-speed data HSD1 may have a positive polarity and a negative polarity with a phase difference of 180 degrees, for example. The high-speed driver 100 may provide the first high-speed data HSD1 to the coupling circuit 200. In an embodiment, the high-speed driver 100 may apply the first high-speed data to the coupling circuit 200 through a plurality of lanes.

The coupling circuit 200 may receive the first high-speed data HSD1 from the high-speed driver 100 and remove a DC component of the first high-speed data HSD1 to generate the second high-speed data HSD2. Detailed description will be given later. The coupling circuit 200 may provide a second high-speed data HSD2 to the passive switch 400. In an embodiment, the coupling circuit 200 may transmit the second high-speed data HSD2 to the passive switch 400 through the plurality of lanes. In an embodiment, the coupling circuit 200 may exist as many as the number of lanes.

The low-power driver 300 may generate low-power data LPD. Here, the low-power data LPD may refer to data transmitted in the low-power-mode in which the host processor 1000 transmits a command such as turning on/off of power or resetting to the display apparatus 2000. In an embodiment, the low-power data LPD may have the data transmission rate of up to about 10 megabits per second (Mb/s) in one lane, for example. In an embodiment, the low-power data LPD may be transmitted using the LVCMOS transmission method, for example. In an embodiment, the low-power data LPD may be the differential signal. In another embodiment, the low-power data LPD may be a single signal. The low-power driver 300 may provide the low-power data LPD to the passive switch 400. In an embodiment, the low-power driver 300 may apply the low-power data LPD to the passive switch 400 through the plurality of lanes. The passive switch 400 may receive the second high-speed data HSD2 from the coupling circuit 200. The passive switch 400 may receive the low-power data LPD from the low-power driver 300. The passive switch 400 may selectively apply the second high-speed data HSD2 or the low-power data LPD to the display apparatus 2000. The passive switch 400 may apply the second high-speed data HSD2 to the coupling circuit 200 in the high-speed period HS (refer to FIGS. 4 and 5) in which the host processor 1000 operates in the high-speed mode. The passive switch 400 may apply the low-power data LPD to the coupling circuit 200 in the low-power periods LP1 and LP2 (refer to FIGS. 4 and 5) in which the host processor 1000 operates in the low-power mode. The data transmission rate in the high-speed mode may be faster than the data transmission rate in the low-power mode. In an embodiment, the high-speed mode may be used to transmit data about a displayed image at high-speed, and the low-power mode may be used to execute the command such as turning on/off of power or resetting, for example.

Figure 3:
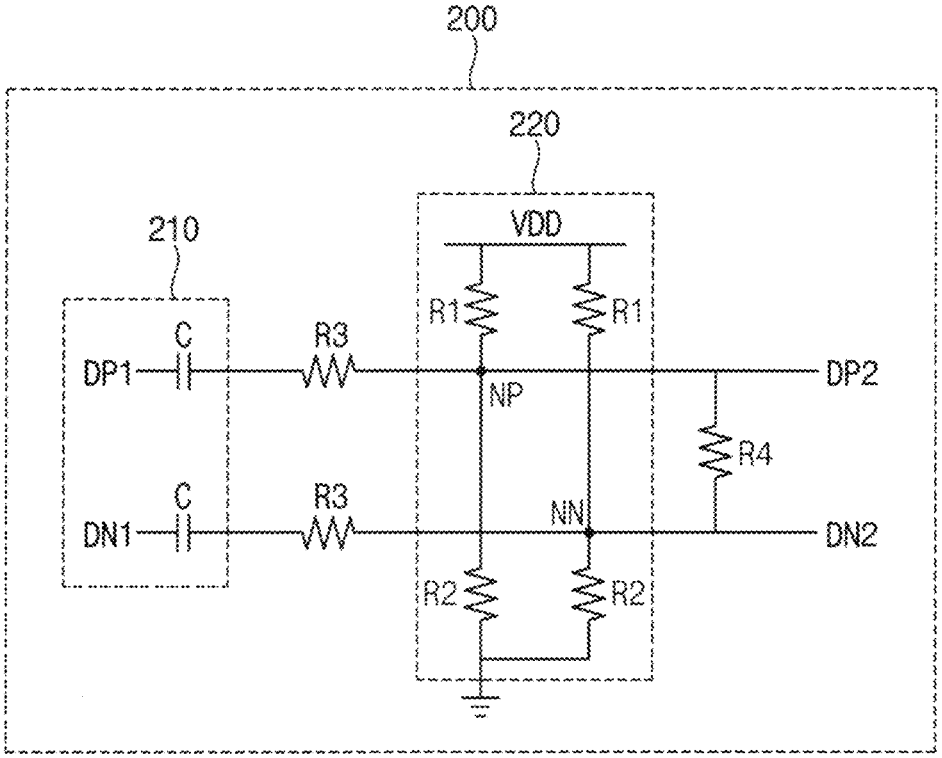
FIG. 3 is a circuit diagram illustrating a coupling circuit included in the display system of FIG. 1.
Figure 4:
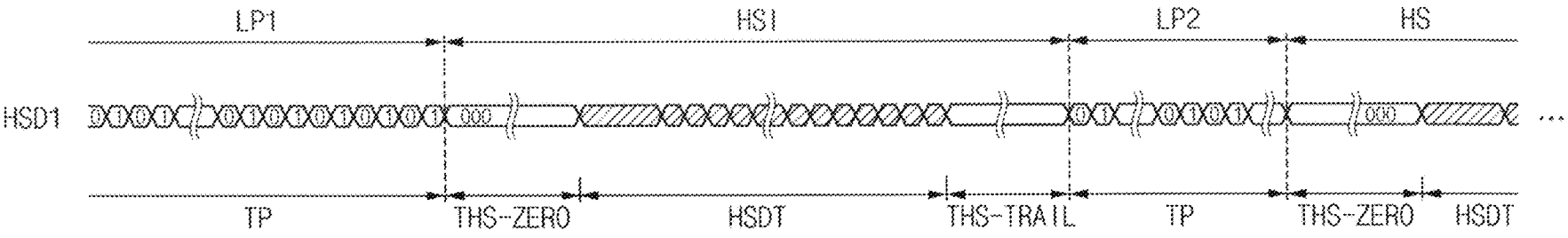
FIG. 4 is a diagram illustrating first high-speed data generated by a host processor included in the display system of FIG. 1.
Figure 5:
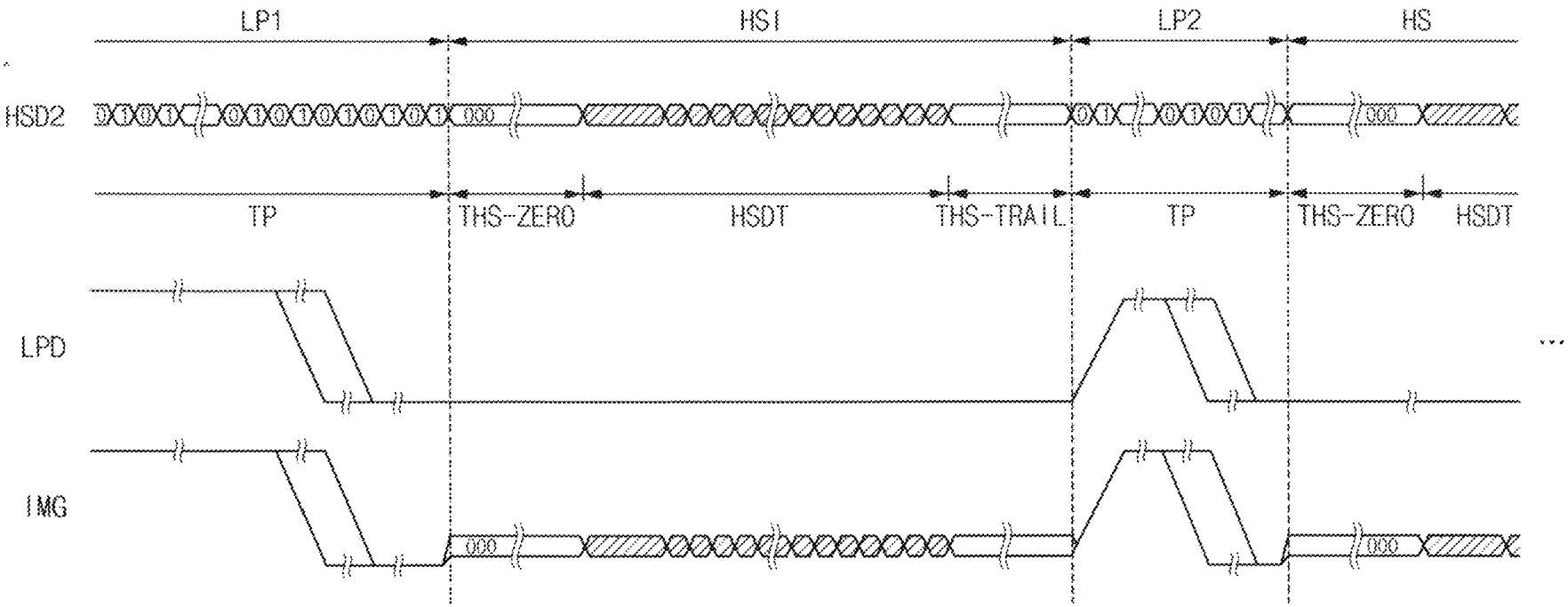
FIG. 5 is a diagram illustrating second high-speed data, low-power data, and input image data generated by a host processor included in the display system of FIG. 1.

FIG. 3 is a circuit diagram illustrating the coupling circuit 200 included in the display system 10 of FIG. 1, FIG. 4 is a diagram illustrating the first high-speed data HSD1 generated by the host processor 1000 included in the display system 10 of FIG. 1, FIG. 5 is a diagram illustrating the second high-speed data HSD2, the low-power data LPD, and input image data IMG generated by the host processor 1000 included in the display system 10 of FIG. 1. In FIGS. 3 to 5, it is assumed that the first high-speed data HSD1 (DP1 and DN1) is the differential signal having the positive polarity and the negative polarity with the phase difference of 180 degrees. In FIGS. 3 to 5, it is assumed that the second high-speed data HSD2 (DP2 and DN2) is the differential signal having the positive polarity and the negative polarity with the phase difference of 180 degrees.

Referring to FIG. 3, the coupling circuit 200 may include a capacitor C for removing the DC component of the first high-speed data HSD1 (DP1 and DN1). The coupling circuit 200 may include a capacitor part 210 removing the DC component of the first high-speed data HSD1 (DP1 and DN1) and a setting part 220 receiving a power supply voltage VDD and setting a DC voltage value of the second high-speed data HSD2 (DP2 and DN2) based on the power supply voltage VDD. The DC voltage value means an intermediate voltage value of a voltage value swinging a predetermined voltage range. The first high-speed data HSD1 (DP1 and DN1) may include positive first high-speed data DP1 having the positive polarity and negative first high-speed data DN1 having the negative polarity having the phase difference of 180 degrees from the positive polarity. The second high-speed data HSD2 (DP2 and DN2) may include positive second high-speed data DP2 having the positive polarity and negative second high-speed data DN2 having the negative polarity having the phase difference of 180 degrees from the positive polarity. In an embodiment, the coupling circuit 200 may further include a third resistor R3 and a fourth resistor R4 for a impedance matching. The setting part 220 may include a first resistor R1 including a first end receiving the power supply voltage VDD and a second end connected to an output node NP and NN, and a second resistor R2 including a first end that is grounded and a second end connected to the output node NP and NN. The setting part 220 may set the DC voltage value of the second high-speed data HSD2 (DP2 and DN2) based on the power supply voltage VDD, a resistance of the first resistor R1, and a resistance of the second resistor R2.

The DC component may be removed from the first high-speed data HSD1 (DP1 and DN1) while passing through the capacitor C included in the capacitor part 210. The setting part 220 may generate the second high-speed data HSD2 (DP2 and DN2) with a newly set DC voltage value based on the first high-speed data HSD1 (DP1 and DN1) from which the DC component is removed, the power voltage VDD, the resistance of the first resistor R1, and the resistance of the second resistor R2. However, when the first high-speed data HSD1 (DP1 and DN1) is not in DC balance, DC distortion may occur. The DC distortion may occur when the first high-speed data HSD1 (DP1 and DN1) has a value of 0 or 1 continuously for a long time (i.e., when the DC balance is not matched). When there is the DC distortion, the first high-speed data HSD1 (DP1 and DN1) may have a higher or lower voltage value than when there is no DC distortion after passing through the capacitor C.

Referring to FIG. 4, the first high-speed data HSD1 may include a preparation period THS-ZERO, an image data period HSDT, and a tail period THS-TRAIL in the high-speed periods HSI and HS. Data of 0 may be transmitted in the preparation period THS-ZERO. The preparation period THS-ZERO may be a period for preparing necessary to transmit the data about the displayed image. The image data period HSDT may be a period in which the first high-speed data HSD1 includes the data about the displayed image. The tail period THS-TRAIL may be a period following the image data period HSDT, and may have a value opposite to the last data value (0 or 1) of the image data period HSDT. The first high-speed data HSD1 and the second high-speed data HSD2 may be the same except for the DC voltage value.

Referring to FIGS. 4 and 5, the first high-speed data HSD1 may have data of 0 or 1 as a differential signal. In an embodiment, the low-power data LPD may have data of 00, 01, 10, or 11, and may have different forms depending on each data, for example. The first high-speed data HSD1 may include a toggle pattern TP. The first high-speed data HSD1 may include the toggle pattern TP in a first low-power period LP1 before an initial high-speed period HSI. Here, the initial high-speed period HSI may mean a first high-speed period after the host processor 1000 is powered-on. The first high-speed data HSD1 may include the toggle pattern TP in a second low-power period LP2. The second high-speed data HSD2 may include the toggle pattern TP in a period in which the first high-speed data HSD1 includes the toggle pattern TP. In an embodiment, the toggle pattern TP may mean a pattern in which 0 and 1 are repeatedly appeared, for example. In an embodiment, the toggle pattern TP may be a pattern in which the DC balance is matched, for example. The second high-speed data HSD2 may be substantially the same as the first high-speed data HSD1 except for the DC voltage value. The input image data IMG may have the low-power data LPD in the low-power periods LP1 and LP2. The input image data IMG may have the second high-speed data HSD2 in the high-speed periods HSI and HS.

Referring to FIGS. 3, 4, and 5, the coupling circuit 200 may set the DC voltage value of the second high-speed data HSD2 in the first low-power period LP1 before the initial high-speed period HSI. The coupling circuit 200 may maintain the DC voltage value of the second high-speed data HSD2 in the second low-power period LP2 after the initial high-speed period HSI.

In an embodiment, since the toggle pattern TP in which 0 and 1 are repeated (i.e., a toggle pattern in which DC balance is matched) passes through the capacitor C in the first low-power period LP1, the DC distortion may not occur, for example. Accordingly, the second high-speed data HSD2 (DP2 and DN2) may be set to a desired DC voltage value. In the first low-power period LP1, a setting time of the DC voltage value of the second high-speed data HSD2 (DP2 and DN2) may increase as a capacitance of the capacitor C increases. The set DC voltage value of the second high-speed data HSD2 (DP2 and DN2) may be maintained in the high-speed periods HSI and HS due to the capacitor C even when there is the DC distortion. In the high-speed periods HSI and HS, a holding time of the DC voltage value of the second high-speed data HSD2 (DP2 and DN2) may increase as the capacitance of the capacitor C increases. Since the DC voltage value of the second high-speed data HSD2 (DP2 and DN2) is maintained in the high-speed periods HSI and HS, the second high-speed data HSD2 (DP2 and DN2) may not have the setting time of the DC voltage value of the second high-speed data HSD2 (DP2 and DN2) in the second low-power period LP2. However, when the holding time of the DC voltage value is exceeded, the DC distortion may occur due to an imbalance of the DC balance in the high-speed periods HSI and HS, so that in the second low-power period LP2, the first high-speed data HSD1 (DP1 and DN1) may include the toggle pattern TP. In an embodiment, in the second low-power period LP2, the toggle pattern TP (that is, a toggle pattern with a DC balance) that repeats 0 and 1 may pass through the capacitor C, so that the toggle pattern TP compensates for the imbalance of the DC balance in the high-speed period (HSI and HS), for example. The setting time may mean a time taken to set the DC voltage value of the second high-speed data HSD2 (DP2 and DN2) to a desired voltage value. The holding time may mean a time during which the set DC voltage value of the second high-speed data HSD2 (DP2 and DN2) is maintained.

Figures 6, 7:
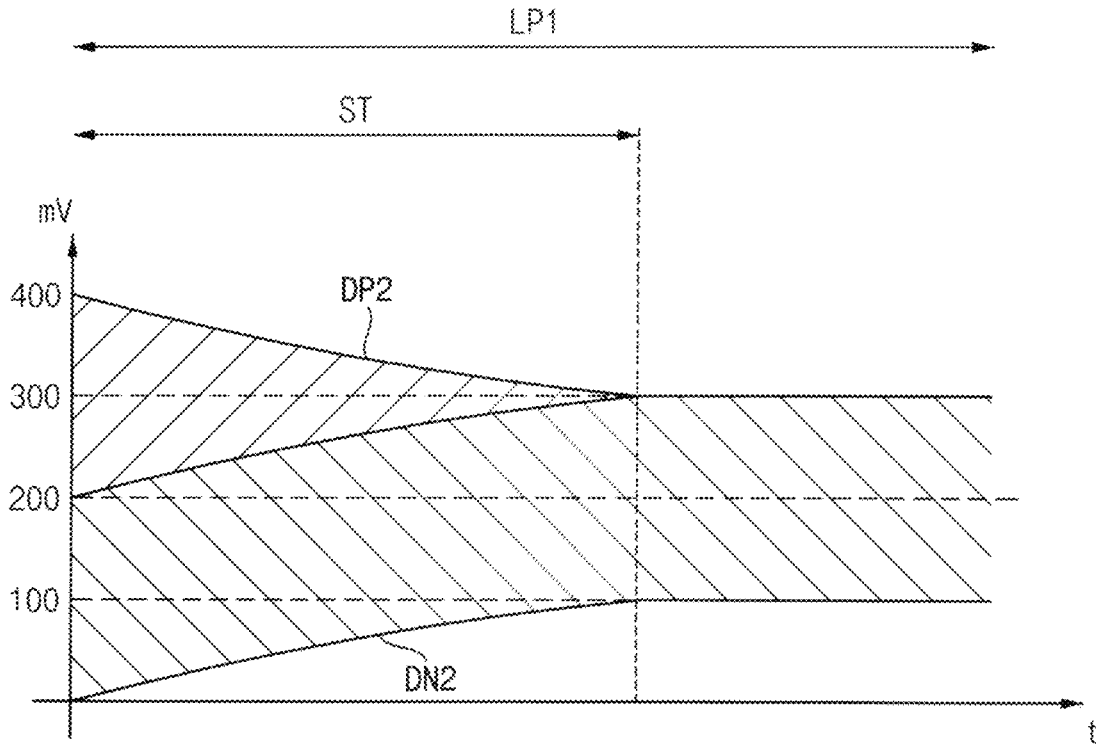
FIG. 6 is a graph illustrating a setting time of the display system of FIG. 1.
FIG. 7 is a table illustrating simulation results of a length of a horizontal period 1H, a length of a high-speed period, and a length of a low-power period depending on a resolution of a display apparatus included in the display system of FIG. 1.

FIG. 6 is a graph illustrating a setting time ST of the display system 10 of FIG. 1, and FIG. 7 is a table illustrating simulation results of a length of a horizontal period 1H, a length of the high-speed period HS, and a length of the low-power period LP depending on the resolution of the display apparatus 2000 included in the display system of FIG. 1. FIGS. 6 and 7 assume that the SLVS transmission method is used in the high-speed period HS.

Referring to FIG. 6, the second high-speed data HSD2 (DP2 and DN2) may set the DC voltage value in the first low-power period LP1. In an embodiment, the second high-speed data HSD2 (DP2 and DN2) may have the setting time ST until it has a DC voltage value of the SLVS transmission method, for example. Since the SLVS transmission method has the DC voltage value of about 200 mV, the time until the DC voltage value of the second high-speed data HSD2 (DP2 and DN2) reaches about 200 mV may be the setting time ST. In an embodiment, when the positive second high-speed data DP2 has a DC voltage value of about 300 mV and the negative second high-speed data DN2 has a DC voltage value of about 100 mV, for example, the toggle pattern TP of the first high-speed data HSD1 (DP1 and DN1) may pass through the coupling circuit 200, so that the DC voltage values of the positive second high-speed data DP2 and the negative second high-speed data DN2 may change to the set DC voltage value. In an embodiment, when the positive second high-speed data DP2 has a DC voltage value of about 300 mV and the negative second high-speed data DN2 has a DC voltage value of about 100 mV, the setting time ST may be a time until the DC voltage values of the positive second high-speed data DP2 and the negative second high-speed data DN2 reach about 200 mV (when the SLVS transmission method is used), for example.

Referring to FIG. 7, when the holding time is shorter than the length of the high-speed period HS, the second high-speed data HSD2 may not maintain the DC voltage value during the high-speed period HS. As the capacitance increases, the holding time may increase. The length of the high-speed period HS may vary depending on the resolution of the display apparatus 2000. Accordingly, the capacitance of the capacitor C may be determined depending on the resolution of the display apparatus 2000. In an embodiment, full high definition ("FHD") (1080p) may have a shorter high-speed period HS than that of wide quad high definition ("WQHD") (1620p) having a higher resolution than that of the FHD (1080p), for example. In an embodiment, a capacitance when the display apparatus 2000 is the WQHD (1620p) may be greater than a capacitance when the display apparatus 2000 is the FHD (1080p), for example. However, since the low-power period LP becomes shorter as the resolution is higher and the setting time ST becomes longer as the capacitance is a higher, an appropriate level of the capacitance is obtained in consideration of the setting time ST and the holding time.

Figure 8:
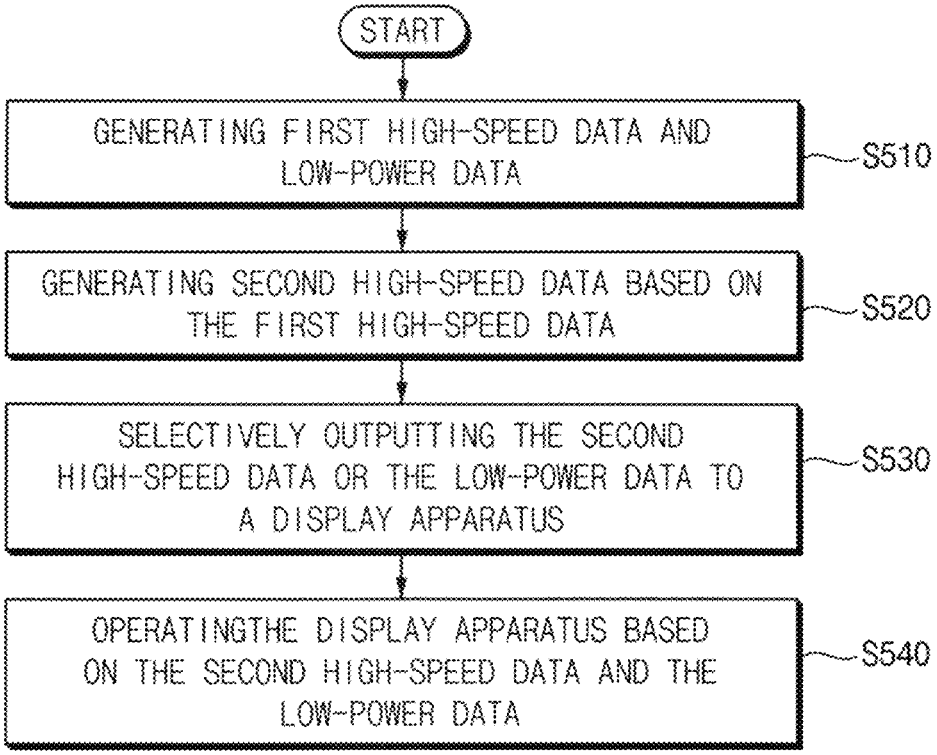
FIGS. 8 and 9 are flowcharts illustrating an embodiment of a method of operating a display system according to the invention.
Figure 9:
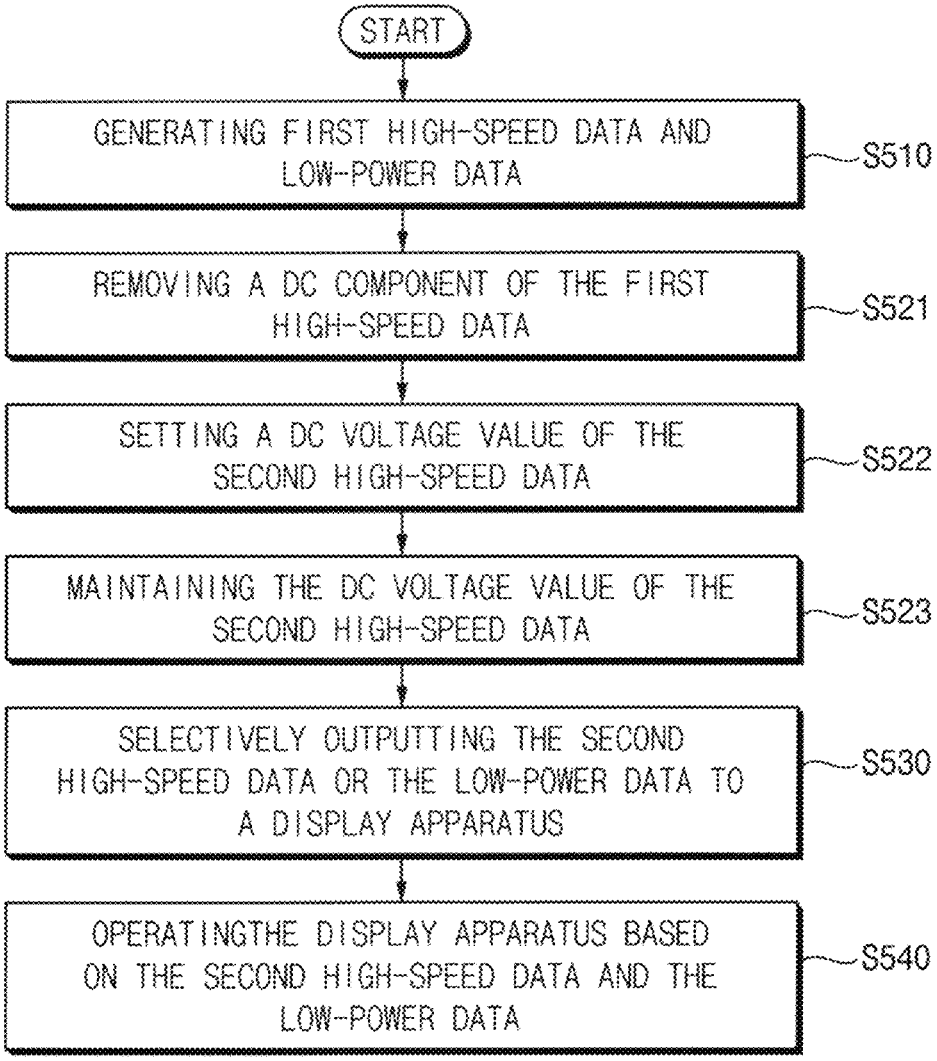

FIGS. 8 and 9 are flowcharts illustrating an embodiment of a method of operating a display system 10 according to the invention.

Referring to FIGS. 8 and 9, the method may include generating the first high-speed data HSD1 and the low-power data LPD (operation S510), generating the second high-speed data HSD2 based on the first high-speed data HSD1 (operation S520), selectively outputting the second high-speed data HSD2 or the low-power data LPD to the display apparatus (operation S530), and operating the display apparatus based on the second high-speed data HSD2 and the low-power data LPD (operation S540). The display apparatus 2000 may display an image based on the input image data IMG including the second high-speed data HSD2 and the low-power data LPD.

Specifically, the method may include generating the first high-speed data HSD1 and the low-power data LPD (operation S510). A transmission rate of the first high-speed data HSD1 may be faster than a transmission rate of the low-power data LPD.

Specifically, the method may include generating the second high-speed data HSD2 based on the first high-speed data HSD1 (operation S520). Generating the second high-speed data may include removing the DC component of the first high-speed data HSD1 (operation S521), setting the DC voltage value of the second high-speed data HSD2 (operation S522), and maintaining the DC voltage value of the second high-speed data HSD2 (operation S523). Removing of the DC component of the first high-speed data HSD1 may be performed through the capacitor C. The DC voltage value of the second high-speed data HSD2 may be set to an appropriate value depending on the transmission method. Setting and maintaining the DC voltage value of the second high-speed data HSD2 may be performed through the toggle pattern TP included in the second high-speed data HSD2. Setting of the DC voltage value of the second high-speed data HSD2 may be performed in the first low-power period LP1 before the initial high-speed period HSI. The maintenance of the DC voltage value of the second high-speed data HSD2 may be performed in the second low-power period LP2 after the initial high-speed period HSI.

Specifically, the method may include selectively outputting the second high-speed data HSD2 or the low-power data LPD (operation S530). The second high-speed data HSD2 may be output in the high-speed period HS operating in the high-speed mode. the low-power data LPD may be output in the low-power periods LP1 and LP2 operating in the low-power mode. The high-speed period HS and the low-power periods LP1 and LP2 may be repeated.

Accordingly, the display system 10 may generate the second high-speed data HSD2 having a new DC voltage value through the capacitor C, so that the generated first high-speed data HSD1 may be normally transmitted even when the generated first high-speed data HSD1 does not have a voltage value corresponding to the transmission method. Also, by including the toggle pattern TP in the first high-speed data HSD1, according to the invention, the DC component may be removed from the first high-speed data HSD1 having the imbalance of the DC balance through the capacitor C. Accordingly, the DC component of the first high-speed data HSD1 may be removed through the capacitor C without additional data.

Embodiments of the inventions may be applied any electronic apparatus including the display apparatus. In an embodiment, the inventions may be applied to a television ("TV"), a digital TV, a three dimensional ("3D") TV, a mobile phone, a smart phone, a tablet computer, a virtual reality ("VR") apparatus, a wearable electronic apparatus, a PC, a home appliance, a laptop computer, a PDA, a PMP, a digital camera, a music player, a portable game console, a navigation apparatus, etc., for example.

The foregoing is illustrative of the invention and is not to be construed as limiting thereof. Although a few embodiments of the invention have been described, those skilled in the art will readily appreciate that many modifications are possible in the embodiments without materially departing from the novel teachings and advantages of the invention.

Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed embodiments, as well as other embodiments, are intended to be included within the scope of the appended claims. Embodiments of the invention are defined by the following claims, with equivalents of the claims to be included therein.

What is claimed is:

1. A host processor which communicates with a display apparatus, the host processor comprising:

a high-speed driver which generates first high-speed data;

a coupling circuit which receives the first high-speed data from the high-speed driver, and removes a direct-current component of the first high-speed data to generate second high-speed data;

a low-power driver which generates low-power data; and a passive switch which receives the second high-speed data from the coupling circuit, receives the low-power data from the low-power driver, and selectively outputs the second high-speed data or the low-power data to the display apparatus.

2. The host processor of claim 1, wherein the coupling circuit includes a capacitor for removing the direct-current component of the first high-speed data.

3. The host processor of claim 2, wherein a capacitance of the capacitor is determined depending on a resolution of the display apparatus.

4. The host processor of claim 1, wherein the first high-speed data includes a toggle pattern.

5. The host processor of claim 4, wherein the coupling circuit sets a direct-current voltage value of the second high-speed data in a first low-power period before an initial high-speed period.

6. The host processor of claim 5, wherein the first high-speed data includes the toggle pattern in the first low-power period before the initial high-speed period.

7. The host processor of claim 6, wherein the coupling circuit maintains the direct-current voltage value of the second high-speed data in a second low-power period after the initial high-speed period.

8. The host processor of claim 7, wherein the first high-speed data includes the toggle pattern in the second low-power period.

9. The host processor of claim 1, wherein the coupling circuit includes:

a capacitor part which removes the direct-current component of the first high-speed data; and a setting part which receives a power supply voltage, and sets a direct-current voltage value of the second high-speed data based on the power supply voltage.

10. The host processor of claim 9, wherein the setting part includes:

a first resistor including a first end which receives the power supply voltage and a second end connected to an output node; and a second resistor including a first end which is grounded and a second end connected to the output node, wherein the setting part sets the direct-current voltage value of the second high-speed data based on the power supply voltage, a resistance of the first resistor, and a resistance of the second resistor.

11. A display system comprising a host processor and a display apparatus, the host processor comprising:

a high-speed driver which generates first high-speed data;

a coupling circuit which receives the first high-speed data from the high-speed driver and removes a direct-current component of the first high-speed data to generate second high-speed data;

a low-power driver which generates low-power data; and a passive switch which receives the second high-speed data from the coupling circuit, receives the low-power data from the low-power driver, and selectively outputs the second high-speed data or the low-power data to the display apparatus.

12. The display system of claim 11, wherein the coupling circuit includes a capacitor for removing the direct-current component of the first high-speed data.

13. The display system of claim 12, wherein the coupling circuit sets a direct-current voltage value of the second high-speed data in a first low-power period before an initial high-speed period.

14. The display system of claim 13, wherein the first high-speed data includes a toggle pattern in the first low-power period before the initial high-speed period.

15. The display system of claim 14, wherein the coupling circuit maintains the direct-current voltage value of the second high-speed data in a second low-power period after the initial high-speed period.

16. The display system of claim 15, wherein the first high-speed data includes the toggle pattern in the second low-power period.

17. The display system of claim 11, wherein the coupling circuit includes:

a capacitor part which remove the direct-current component of the first high-speed data; and a setting part which receives a power supply voltage and sets a direct-current voltage value of the second high-speed data based on the power supply voltage.

18. A method of operating a display system, the method comprising:

generating first high-speed data and low-power data;

generating second high-speed data based on the first high-speed data;

selectively outputting the second high-speed data or the low-power data to a display apparatus; and operating the display apparatus based on the second high-speed data and the low-power data, wherein the generating the second high-speed data comprises:

removing a direct-current component of the first high-speed data;

setting a direct-current voltage value of the second high-speed data; and maintaining the direct-current voltage value of the second high-speed data.

19. The method of claim 18, wherein the first high-speed data includes a toggle pattern.

20. The method of claim 18, wherein setting the direct-current voltage value of the second high-speed data is performed in a first low-power period before an initial high-speed period, and wherein maintaining the direct-current voltage value of the second high-speed data is performed in a second low-power period after the initial high-speed period.

* * * * *